United States Patent [19]

Maurer et al.

[11] 4,273,502

[45] Jun. 16, 1981

[54] BOOM LOCK MEANS

[75] Inventors: Herman J. Maurer; Wayne G. Smith, both of Burlington, Iowa

[73] Assignee: J. I. Case Company, Racine, Wis.

[21] Appl. No.: 21,265

[22] Filed: Mar. 16, 1979

[51] Int. Cl.[3] ..... E02F 3/32

[52] U.S. Cl. ..... 414/694; 212/229

[58] Field of Search ..... 414/680, 685, 694, 717, 414/722; 212/35 R, 46 A, 229; 298/38

[56] References Cited

U.S. PATENT DOCUMENTS 3,921,835 11/1975 Baker et al. ..... 414/460 X 4,074,821 2/1978 Long ..... 414/690

FOREIGN PATENT DOCUMENTS 615123 12/1926 France ..... 298/38

*Primary Examiner*—Leslie J. Paperner

*Attorney, Agent, or Firm*—Dressler, Goldsmith, Shore, Sutker & Milnamow, Ltd.

[57] ABSTRACT

A releasable locking mechanism for holding a boom in a stored position on a support consists of a latch pivotally supported on the boom and normally held in a first position with a pin carried by the swing tower and aligned with the latch. The pin and latch are positioned such that movement of the boom to the stored position will automatically pivot the latch and produce an interlocking relationship. The release mechanism consists of first and second pivotally interconnected elements, one of which is supported along the pivot axis for the swing tower on the vehicle and the second element having a control member extending therefrom to the operator's station. A universal connection is provided between the control member and the second element, and is located along the vertical pivot axis for the swing tower.

6 Claims, 7 Drawing Figures

62
58
56
50
52
54
60
76
80
90
94
102
92
104
88
82
3.
20a
14

96
98
80
86
84
94
104
102
54
50
60
62
56
52
66
82
76
74
72
68
70
14
16
64
4.

64
62
66
52
72
68
20a
3.

BOOM LOCK MEANS

TECHNICAL FIELD

The present invention relates generally to earthworking implements, such as backhoes, and more particularly to an improved releasable lock mechanism for locking a boom in a transport position on a swing tower supported on the vehicle.

Most commercially available backhoes consist of a boom that is pivoted on a support or swing tower with an earthworking tool or bucket assembly pivoted on the free end of the boom. Both the boom and the bucket assembly are normally pivoted by a fluid ram.

One type of such earthworking implement is disclosed in Long et al. U.S. Pat. No. 3,376,984 which is commonly referred to as an "overcenter" boom. In this construction, the boom can be moved to a transport or stored position wherein the longitudinal axis of the boom is located forward of the axis for the boom fluid ram and a plane extending through the pivotal connections for the boom and the fluid ram on the swing tower.

In order to securely lock the boom in the transport position for movement from one job site to another, it has become customary to provide a positive interlock between the boom and its support.

BACKGROUND PRIOR ART

Various types of positive interlocks have been proposed and examples of two types that are presently being used commercially are disclosed in U.S. Pat. Nos. 3,811,582 and 3,921,835, both assigned to the assignee of the present invention. While both types of interlocks disclosed in the respective patents have been successful and been accepted in the industry, manufacturers are constantly striving for new features which can be incorporated into the vehicle at a minimum cost.

SUMMARY OF THE INVENTION

According to the present invention, the boom is positively locked in a predetermined angular or transport position merely by moving the boom to the transport position during which time interlocking elements engage each other and automatically lock when the boom reaches the transport position. While not specifically limited to any type of earthworking implement, the present invention is particularly adapted for use in connection with what may be referred to as a twin boom concept, such as that disclosed in U.S. Pat. No. 4,074,821.

The releasable lock mechanism consists of a latch mechanism that is pivotally supported on the boom and is normally biased to a first position with the latch having a spaced defined thereon for receiving a pin that is fixedly secured to the swing tower upon which the boom is supported. The latch is designed such that a free end portion thereof engages the top surface of the pin when the boom approaches the transport position and slides along the pin to be automatically pivoted from a first position to a second position. When the boom reaches the transport position the space on the latch is aligned with the pin and the biasing mechanism automatically moves the latch to the first position wherein the boom is locked onto the swing tower.

The boom lock also incorporates a release mechanism that is supported generally along the vertical pivot axis between the swing tower and the vehicle frame and consists of first and second pivotally interconnected elements that are normally biased to a first position with a control member extending from the second element to the operator's station. A universal connection is provided between the control member and the second element, and is located along the vertical pivot axis so that movement of the swing tower on the vehicle will not result in any movement of the control member.

In the specific embodiment illustrated, the latch consists of first and second U-shaped members that are transversely spaced from each other and are pivoted on spaced boom elements of a boom with first and second pins fixed to the swing tower and aligned with the respective latch members. A single release member is provided which has overlapping portions respectively aligned with the latch members so that both latch members can be simultaneously released.

DETAILED DESCRIPTION

Figure 1:
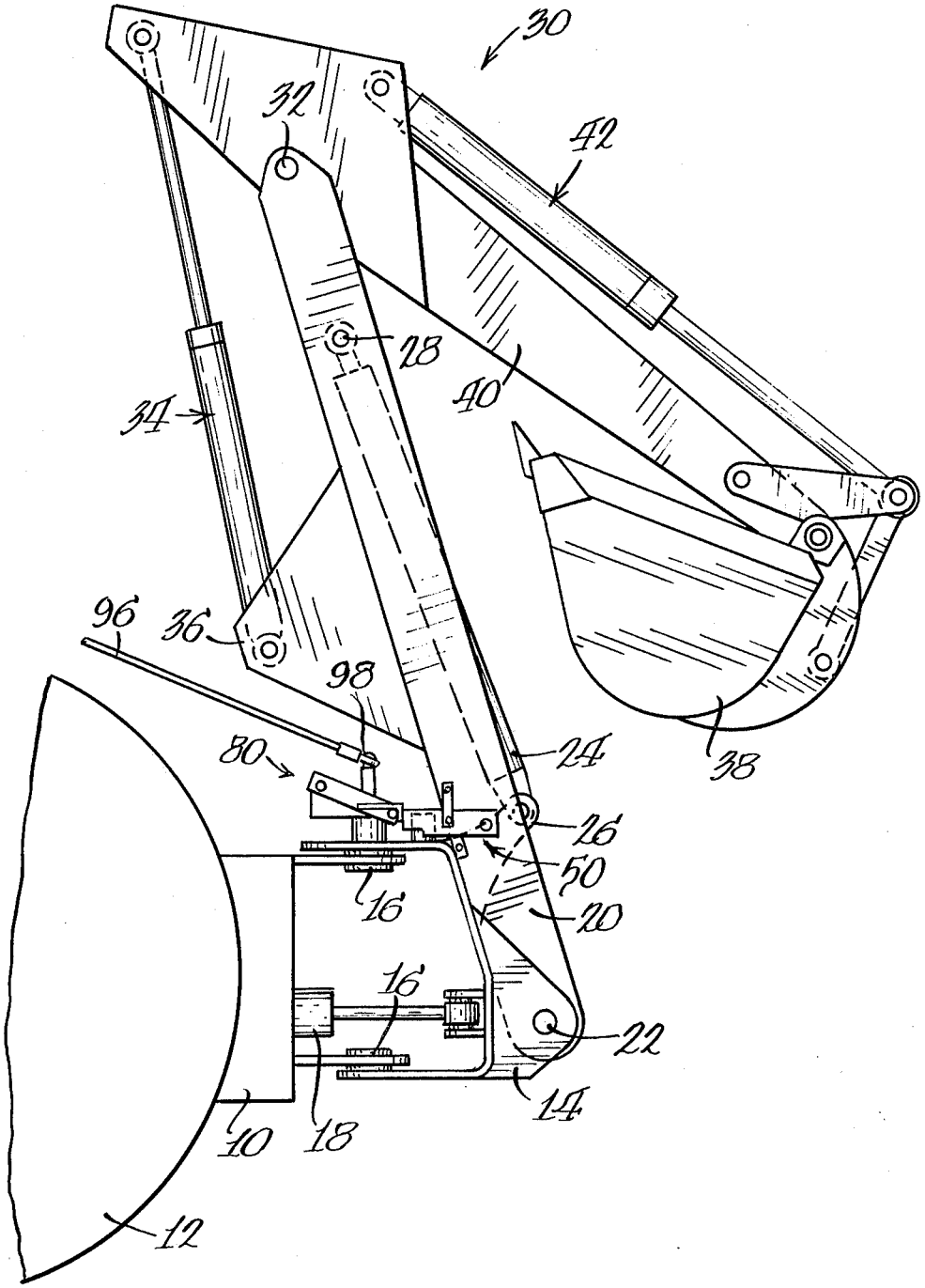
FIG. 1 shows a side elevation view of an earthworking implement having the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings shows part of a vehicle having a vehicle frame 10 supported by wheels 12 with a swing tower or implement frame 14 pivotally supported on vehicle frame 10 thorugh a pair of pins 16 interconnecting two pairs of legs respectively extending from the frame and swing tower so that the swing tower is pivoted about a generally vertical axis. The swinging movement is produced by fluid rams 18 interposed between frames 10 and 14. A boom 20 has one end pivoted about a generally horizontal pivot axis 22 on swing tower 14 through a boom fluid ram 24 that has one end pivotally connected to a bracket 26 extending from swing tower 14. The opposite end of fluid ram 24 is pivotally connected by a pivot pin 28 to boom 20 adjacent the opposite end thereof.

A dipper stick assembly generally designated by reference numeral 30 is pivotally connected by a pin 32 to the outer free end of boom 20 and is pivoted thereon through a tool fluid ram 34 interposed between an integral extension 36 on boom 20 and a free end portion of dipper assembly 30. Dipper assembly 30 includes a bucket 38 pivoted on the outer free end of member 40 through a fluid ram 42.

With the apparatus so far described, extension and retraction of fluid ram 34 will pivot intermediate member 40 on the outer end of boom 20 to position bucket 38 at a desired location for a digging operation. The bucket can then be manipulated through the use of bucket fluid arm 42 and boom fluid ram 24. When the vehicle is to be moved from one job site to another, the dipper assembly 30 is moved to a fully retracted position with respect to boom 20, as illustrated in FIG. 1, and the boom fluid ram is then manipulated to move boom 20 to a transport position wherein the longitudinal axis running through pivot points 22 and 32 is located forward of the longitudinal axis for fluid ram 24 and an adjacent surface of boom 20 is in engagement with an exposed surface of swing tower 14.

As explained above, the boom 20 is preferably of the type disclosed in Long U.S. Pat. No. 4,074,821, which is incorporated herein by reference, and consists of transversely spaced boom elements 20*a* that are interconnected at the upper and lower ends as well as an intermediate portion in a manner more fully described in the Long patent.

According to the present invention, a unique locking mechanism is incorporated into the earthworking implement which includes a minimum number of parts that are inexpensive to construct and are easy to operate. The lock mechanism of the present invention is most clearly illustrated in FIGS. 2 and 3 and consists of first and second latches 50 that are pivotally supported on boom elements 20*a* through pivot pins 52 that define a common pivot axis. Each latch is generally U-shaped and has a bite portion 54 with a pair of legs 56 extending generally parallel to each other from opposite ends of bit portion 54. Legs 56 are positioned on opposite sides of boom element 20*a* and the free ends thereof are pivotally supported thereon through pin 52. Bite portion 54 and legs 56 cooperate to define a space 58 which is adapted to receive a locking pin means 60 which is in the form of a circular pin for each latch and pins 60 are secured to the top surface of swing tower 14 and may be welded thereto, if desired. Each latch 50 is normally biased to a first position, illustrated in FIG. 3 through biasing means in the form of a semi-rigid strap which may be formed from a FABRIKA material. Biasing strap 62 has one end secured through a connection 64 to boom element 20*a* while the opposite end thereof is connected to an outer leg of latch 50 through a connection 66.

Each latch 50 also has a motion limiting means in the form of a strap member 68 that is secured to outer leg 56 and has an elongated slot 70 which receives a screw 72 that is secured to the outer surface of boom element 20*a*. Bite portion 54 of bracket 50 also has a cutout portion 74 extending from the lower surface thereof and the surface of cutout portion 74 defines a pin engaging surface, for a purpose that will be described later. Each latch 50 also has an L-shaped element 76 secured to the bite portion 54 for a purpose that will be described later.

Figure 2:
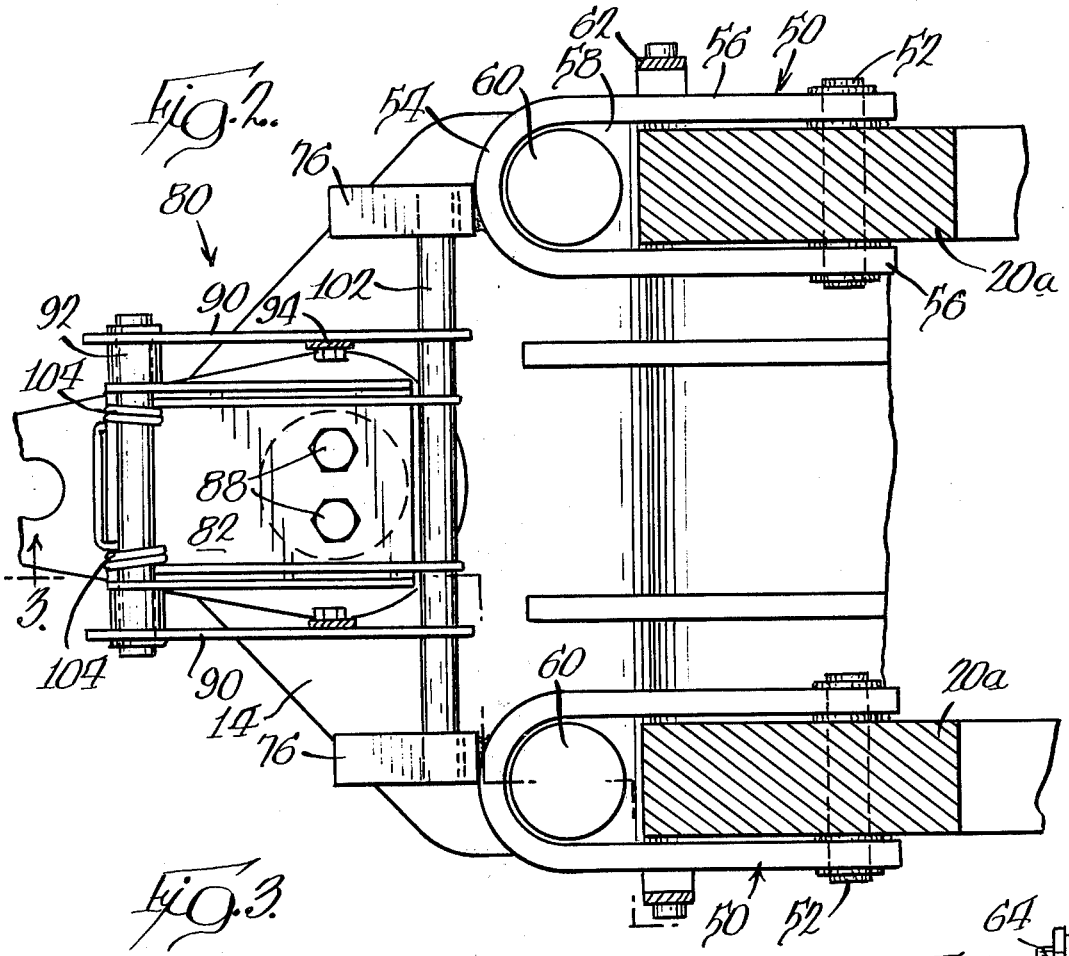
FIG. 2 is a horizontal section through a portion of the boom showing the details of the latch mechanism.
Figure 3:
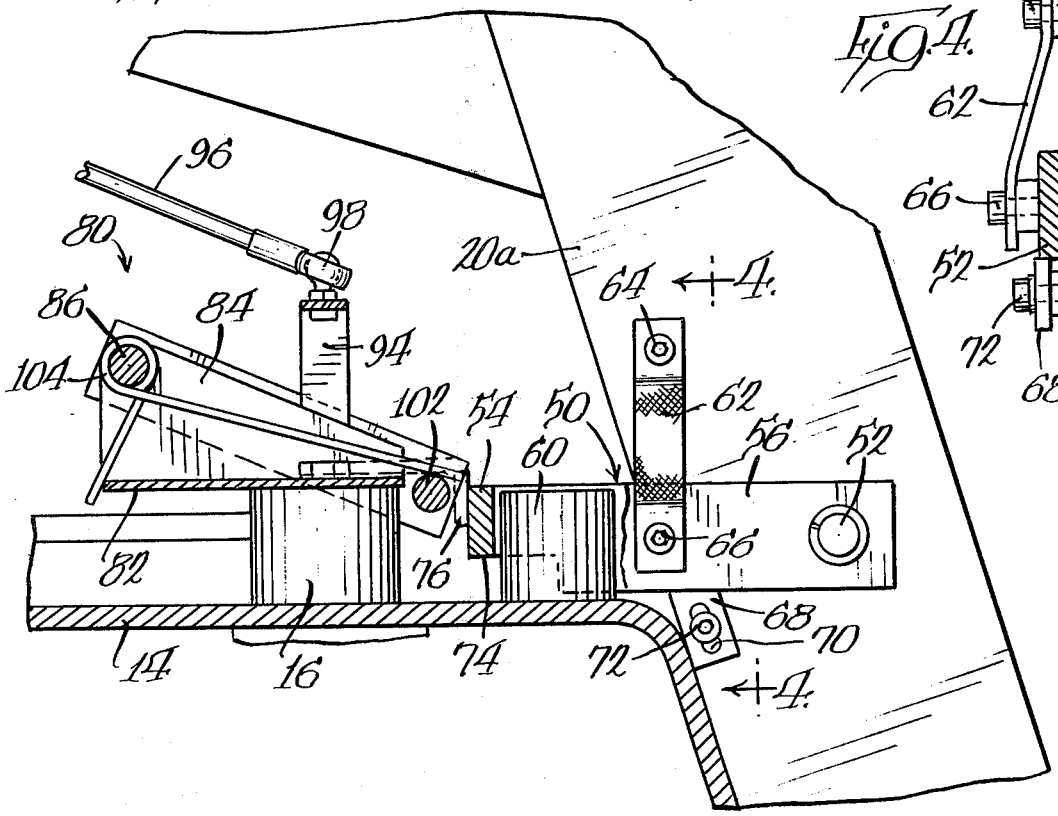
FIG. 3 is a fragmentary vertical section as viewed along line 3—3 of FIG. 2.
Figure 4:
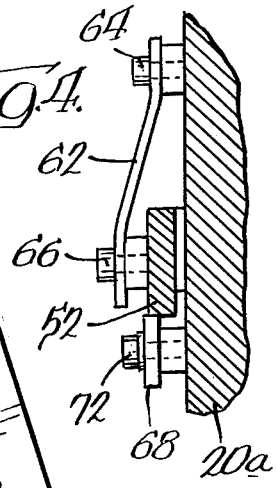
FIG. 4 is a fragmentary sectional view, as viewed along line 4—4 of FIG. 3.
Figure 5:
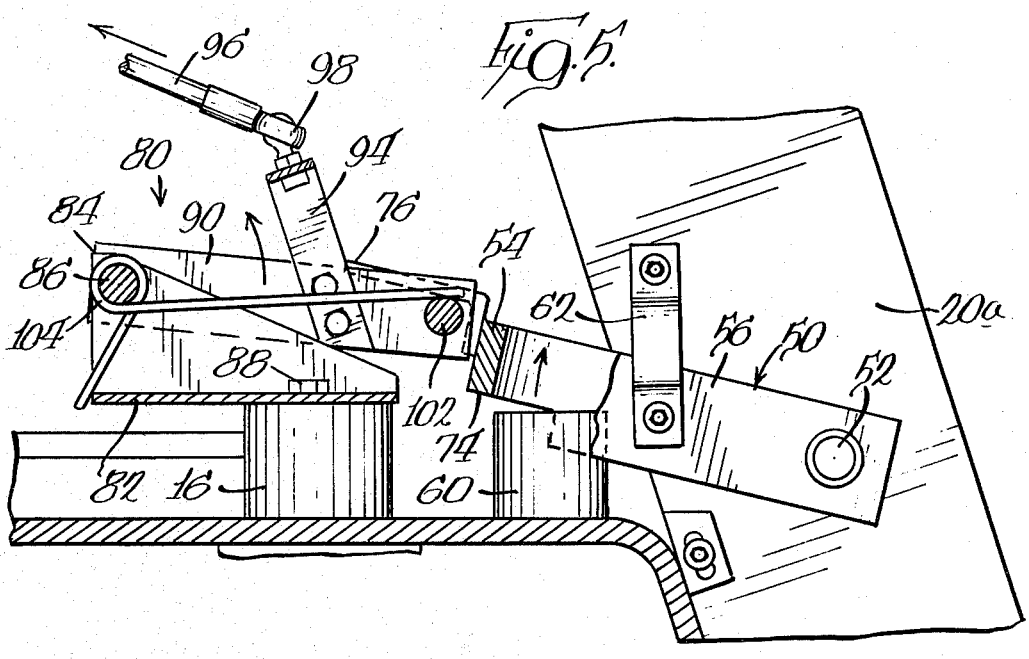
FIG. 5 is a view similar to FIG. 3 showing the position of the components as the latch is being released.

The lock means also includes unlatching means 80 for pivoting latches 50 from the position illustrated in FIG. 3 to that illustrated in FIG. 5. Unlatching means 80 includes first and second elements 82 and 84 that are pivotally interconnected by a pin 86. First element 82 is fixedly secured to the upper end of pivot pin or post 16 through a pair of screws 88. As illustrated in FIGS. 2 and 3, the first element 82 is generally U-shaped in cross section and has a pair of legs extending upwardly from a base portion which is secured to post 16. A single pin 86 extends through both legs as well as through a pair of arms 90 that define the second element 84. Preferably, spacer sleeves 92 are interposed between the legs of first element 82 and arms 90. Arms 90 are interconnected by a generally U-shaped bracket 94 which defines part of a connection for a control member 96 that extends to the operator's station located on vehicle frame 10.

According to one aspect of the invention, the connection between U-shaped bracket 94 and control member or rod 96 is in the form of a conventional universal connection 98 that is located along the vertical axis for swing tower 14. An unlatching rod 102 extends through openings defined on the free ends of the respective arms 90 and the free ends of unlatching rod 102 are positioned in overlapping relation with L-shaped brackets 76 on the respective latches 50 to defined overlapping portions that are adapted to engage each other, as will be described later. The second element 84 consisting of arms 90, U-shaped bracket 94 and unlatching rod 102 are normally biased to a first position illustrated in FIG. 3 by a pair of springs 104 that each have an intermediate portion wound around pin 86 with one free end engaging element 82 and the opposite free end engaging rod 102.

Figure 7:
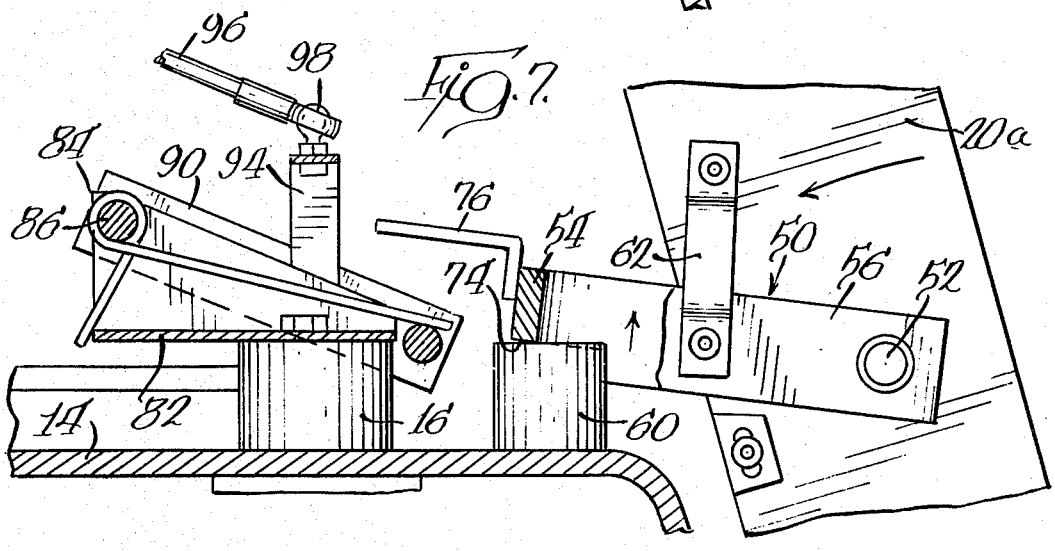
FIG. 7 is a view similar to FIG. 5 showing the position of the components as the boom moves into the transport position.

Considering now the operation of the latching mechanism described above, and assuming that the boom has been in a working position and is to be moved to a transport position for movement of the vehicle from one job site to another, fluid ram 24 is manipulated such that boom 20 is moving towards the transport position to a position generally illustrated in FIG. 7. In the position, the exposed surface of cutout portion 74 engages the top surface of pin 60 and thus causes latch 50 to be moved from the position illustrated in FIG. 7 to a second position during which the flexible strap 62 is compressed. When the inner surface of bite portion 54 moves beyond the periphery of pin 60, the biasing force of strap 62 will automatically cause the latch 50 to move from the second raised position to the first latched position illustrated in FIG. 3 and the boom 20 is automatically locked to swing tower 14.

Figure 6:
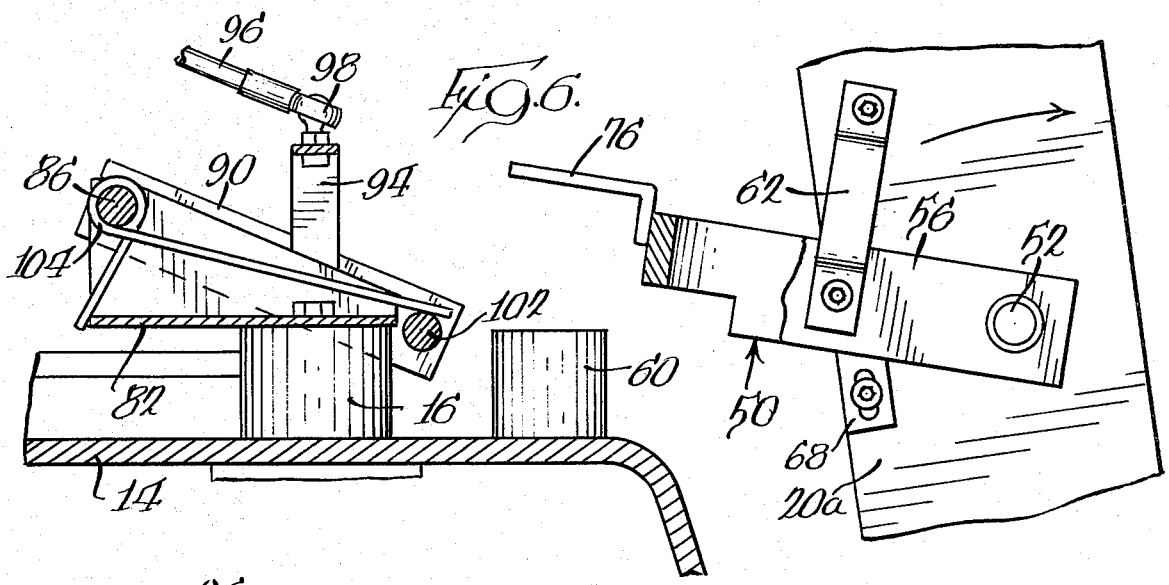
FIG. 6 is a view similar to FIG. 5, showing the position of the components in the released condition.

If it becomes necessary to unlatch the boom, the operator grasps the free end of control rod or handle 96 and applies a pulling force thereto. This force will cause the second element 84 to pivot about pivot pin 86 from the first position illustrated in FIG. 3 to the position illustrated in FIG. 5 which produces engagement between the ends of rod 102 and brackets 76 and causes latches 50 to pivot from the first position illustrated in FIG. 3 to the second released position illustrated in FIG. 5. While in such second position, the operator then manipulates fluid ram 24 to move the boom from the position illustrated in FIG. 5 to the position illustrated in FIG. 6 wherein the boom is released and is capable of being moved to a working position.

One of the significant advantages of the present invention is the fact that the entire latching and unlatching operation can be performed by the operator without leaving the operator's station. Furthermore, the particular interconnection between control rod 96 and unlatching element 84 is positioned on the axis for swing tower 14 so that movement of the swing tower about pivot pins 16 will not result in any movement of control member 96. All of the components that are needed for incorporating the latch mechanism into an earthworking implement are inexpensive components that are readily available and can be assembled in a very short period of time. In fact, the components could readily be incorporated into an existing earthworking implement with only minimal modification thereof.

It should also be pointed out that while the preferred embodiment of the invention illustrates two generally U-shaped latches 50 for the respective boom elements 20*a*, the same concept could be incorporated into a single member boom of the type disclosed in Long et al. U.S. Pat. No. 3,376,984 which would require only a single U-shaped latch 50 and a single pin 60 and would also simplify the construction of the unlatching mechanism.

What is claimed is:

1. In a vehicle having a operator's station and an implement frame supported thereon with a boom pivoted on said frame and movable between transport and working positions, and releaseable latch means for locking said boom in said transport position on same said frame, said releaseable latch means comprising: pin means fixed to said frame at a location horizontally spaced from the pivot for said boom; a generally U-shaped latch having a pair of legs extending from a bite portion with said legs pivoted on said boom about a generally horizontal pivot axis spaced from the pivot for said boom and disposed towards said pin means such that said bite portion and legs cooperate to define a open space for receiving said pin means when said boom is in its transport position; biasing means, linking said boom with said latch, for normally maintaining said latch in a first position where said pin means is received within said open space when said boom in its transport position and for accommodating movement to a second position under the influence of said said pin means while said boom is moving to said transport position and for returning said latch to said first position when said open space is aligned with said pin means; unlatching means, fixed to said frame, for pivoting said latch from said first position to said second position, said unlatching means including a first element secured to said implement frame, a second element pivoted on said first element, and means, between said first and said second elements, for normally maintaining said second element in a first position, said second element and said latch having overlapping portions adapted to engage each other when said second element is in its first position and said latch is in its first position; and a control member connected to said second element and extending to said operator's station for pivoting said second element from said first position to its second position, whereby with said boom raised to its transport position and with said latch and said second element in their first positions, said latch is freed from said pin means through the operation of said control member by pivoting said latch to said second position whereupon said boom is free to pivot away from said transport position to a working position.

2. A vehicle as defined in claim 1, in which said implement frame is a swing tower pivoted on said vehicle by a pivotal connection defining a vertical pivot axis and said first element is carried by said pivotal connection.

3. A vehicle as defined in claim 2, in which the connection between said control member and said second element includes a universal connection located along said vertical pivot axis.

4. A vehicle as defined in claim 1, further including a second U-shaped latch transversely spaced from the first U-shaped latch and pivoted about a common pivot axis with said second element having overlapping portions with both latches.

5. In a vehicle having an operator's station and an implement frame supported thereon with a boom composed of two parallel spaced apart members pivoted on said frame and movable between transport and working positions, and a releasable latch for locking said boom in said transport position on said frame, said releasable latch comprising: pin means fixed to said frame at a location spaced from the pivot for said boom; a pair of generally U-shaped latches transversely spaced from one another and pivoted about a common pivot axis to said parallel spaced apart members, each latch having a pair of legs extending from a bite portion the free ends of which are pivoted to said boom and disposed towards said pin means such that with said boom in its transport position said bite portion and legs cooperate together to define an open space into which said pin means is receivable; biasing means, linking said boom with said latches for normally maintaining said latches in a first position and for accomodating movement to a second position under the influence of said pin means while said boom is moving to its transport position, said biasing means returning said latches to their first position when said open space is aligned with said pin means; unlatching means, fixed to said implement frame, for pivoting said latches from their first position to their second position, said unlatching means including a first element secured to said implement frame, a pair of spaced arms supported on a pin defining the pivot between said arms and said first element, and means for normally maintaining said arms in a first position, a release rod interconnecting the free ends of said arms, the free ends of said release rod underlying said latches so as to engage one another; and a control member, connected to said arms and extending to said operator's station, for pivoting said arms from their first position to their second position, whereby with said boom in its transport position said latches in their first position and said arms in their first position said boom is released from said transport position by operating said control member to raise said arms to said second position, the free ends of said release rod pivoting said latches to their second position where said pin means is out of engagement with the open space defined by said latches.

6. A vehicle as defined in claim 5, in which each bite portion of each latch has a bracket secured thereto and said brackets are respectively aligned with said free ends of said release rod.

* * * * *